US006807700B2

(12) United States Patent
Panther et al.

(10) Patent No.: US 6,807,700 B2
(45) Date of Patent: Oct. 26, 2004

(54) ACOUSTICAL LAUNDRY TUB BLANKET

(75) Inventors: Allen L. Panther, Newark, OH (US); Phil Johnson, Louisville, KY (US)

(73) Assignee: Owens Corning Fiberglass Technology, Inc., Summit, IL (US)

( * ) Notice: Subject to any disclaimer, the term of this patent is extended or adjusted under 35 U.S.C. 154(b) by 310 days.

(21) Appl. No.: 10/191,838

(22) Filed: Jul. 9, 2002

(65) Prior Publication Data

US 2004/0007028 A1 Jan. 15, 2004

(51) Int. Cl.[7] ..... D06F 37/00
(52) U.S. Cl. ..... 8/158; 68/3 R; 68/213
(58) Field of Search ..... 68/3 R, 13 R, 68/213, 235 R; 8/158; 134/200, 201

(56) References Cited

U.S. PATENT DOCUMENTS

| | | | | |
|---|---|---|---|---|
| 4,461,796 A | * | 7/1984 | Fukahori et al. | 428/116 |
| 5,044,705 A | | 9/1991 | Nelson | |
| 5,263,343 A | | 11/1993 | Lee | |
| 5,412,825 A | * | 5/1995 | Moon | 8/159 |
| 5,549,760 A | | 8/1996 | Becker | |
| 5,855,353 A | * | 1/1999 | Shaffer et al. | 248/638 |
| 6,512,831 B1 | * | 1/2003 | Herreman et al. | 381/71.3 |

FOREIGN PATENT DOCUMENTS

| | | | |
|---|---|---|---|
| DE | 19 38 115 | | 5/1966 |
| DE | 88 10 158 | | 3/1988 |
| DE | 44 43 919 | | 6/1996 |
| DE | 198 58 002 | * | 6/2000 |
| DE | 100 03 185 | * | 3/2001 |
| GB | 1 536 089 | | 12/1978 |
| JP | 59-77899 | * | 5/1984 |
| JP | 2-126888 | * | 5/1990 |
| JP | 2-220692 | * | 9/1990 |
| JP | 2-295592 | * | 12/1990 |
| JP | 3-289997 | * | 12/1991 |
| JP | 10-103404 | * | 4/1998 |
| WO | WO 02/26100 | | 4/2002 |

* cited by examiner

*Primary Examiner*—Frankie L. Stinson
(74) *Attorney, Agent, or Firm*—Inger H. Eckert; Maria C. Gasaway

(57) ABSTRACT

Methods and apparatus are provided for acoustically insulating a washing machine and, specifically, a laundry tub. An acoustical blanket of thermoplastic material extends around and insulates the laundry tub. A wall of the tub has at least one protuberance for mating with a hole of the acoustical blanket. The acoustical blanket may be crimped over a top of the wall. Protuberances include knobs and elongate members. The thermoplastic material is selected from a group consisting of a polyester, polyethylene, polyolefin, polypropylene, polyethylene terephthalate, rayon, nylon, acrylic, hemp, kenaf, cotton and combinations thereof. A facing layer(s) may additionally be provided on the acoustical blanket. The facing layer being selected from a group consisting of polyester, rayon, metallic foil and combinations thereof. The blanket may also mate directly with a cylinder around the tub.

15 Claims, 7 Drawing Sheets

ACOUSTICAL LAUNDRY TUB BLANKET

TECHNICAL FIELD AND INDUSTRIAL APPLICABILITY OF THE INVENTION

The present invention relates generally to washing machines and, more particularly, to methods and apparatus for acoustically insulating a laundry tub thereof with an acoustical insulation blanket.

BACKGROUND OF THE INVENTION

Washing machines have long been known as a convenient and efficient way to launder clothes following their use. In general, washing machines include a laundry tub for holding user-inserted clothes and washing soap and hot or cold water. During use, an agitator in the tub pivotally reciprocates thereby cleaning the clothes by mixing the water, soap and clothes together. Thereafter, clean water rinses the clothes and the tub spins to remove excess water. Unfortunately, this process generates considerable noise which can annoy users. In an effort to reduce this noise, those skilled in the art have covered the laundry tubs and/or other noise sources with acoustical insulation.

Conventional acoustical insulation for washing machines generally comprises sound transmission barriers and sound absorption layers. Typically, acoustical insulation involves enclosing the noise source in an insulation structure, such as a mineral fiber insulation, i.e., fiberglass, thereby attenuating the transmission of unwanted noise emanating from the washing machine.

The use of fiberglass, however, adversely causes skin irritability problems for handlers. Thus, more modem acoustical insulators have enclosed the fiberglass in polyethylene bags, for example. While generally successful at preventing skin irritations, the bags can be cumbersome and bulky thereby causing other handling issues. They also tend to prevent close tolerance fits between the tub and washing machine housing which can become a critical limitation since the laundry tub is required to spin many times during its lifetime.

Moreover, the bag has a tendency to "catch" on other objects which further complicates packaging and handling. Of course, the bag may also catch during the routine spin cycles of the washing machine. Consequently, if it does catch, it will likely tear thereby exposing handlers and machine owners to the fiberglass. It may also create a sloppy appearance likely to detract from a customer's satisfaction of the individual washing machine and/or company that manufactures/sells the machine.

In addition, manufacturers presently provide bag-wrapped-fiberglass with awkward straps, often metal, pierced through the bag to attach to mating clips on the laundry tub during installation. In turn, the straps add manufacturing steps and the metal may vibrate during spin cycles thereby increasing noise, not reducing it.

Accordingly, the washing machine arts desire improved acoustical insulation methods and apparatus for better meeting the needs of manufacturers, handlers and users.

SUMMARY OF THE INVENTION

In accordance with the purposes of the present invention as described herein, methods and apparatus are provided for acoustically insulating a laundry tub of a washing machine. The washing machine comprises a lid that provides user access to an interior of the laundry tub for depositing soiled laundry and washing soap. The laundry tub has a wall with one side disposed towards the interior and another side disposed towards an exterior. The exterior of the wall has at least one protuberance thereon. An acoustical blanket of thermoplastic material, with at least one hole therein, extends about and fits snugly against the exterior of the wall. The protuberance mates with and fills the hole of the acoustical blanket.

In other embodiments, the acoustical blanket has cutouts for providing access to the wall of the laundry tub and/or complimentary configured terminal ends. The laundry tub has single or multiple protuberances for mating with single or multiple holes of the acoustical blanket. The protuberances include vertically arranged protuberances, peripherally arranged protuberances or other. Preferred structures of protuberances include knobs or elongate members that may or may not mate with a recess of the wall.

In another embodiment, the acoustical blanket may mate directly with the washing machine instead of the laundry tub.

In accordance with yet another aspect of the present invention, a method is provided for providing a laundry tub with a protuberance on a wall thereof, enclosing the laundry tub with an acoustical blanket of thermoplastic material having a hole, and mating the protuberance with the hole. Crimping the acoustical blanket and providing wall access are also disclosed.

Still further, the acoustical blanket is formed from a polymer based thermoplastic material. That polymer based thermoplastic material is selected from a group consisting of a polyester, polyethylene, polyolefin, polypropylene, polyethylene terephthalate, rayon, nylon, acrylic, hemp, kenaf, cotton and combinations thereof.

The acoustical blanket may be composed of polyester staple fibers and polyester bicomponent fibers of distinct diameters typically between 8.0 and 50.0 microns and distinct lengths typically between 0.5 and 3.0 inches. It may also include melt blown microfibers.

In addition, the thermoplastic blanket may include a facing layer on the thermoplastic blanket. That facing layer may be selected from a group consisting of polyester, rayon, metallic foil and combinations thereof.

While the acoustical blanket derives its size from the size of the laundry tub, it may, in one embodiment, be described as comprising a layer of thermoplastic material having a length of about 50 inches, a height of about 17 to 20 inches, and a thickness of about ¾ to 1½ inches.

In the following description there is shown and described methods and apparatus for acoustically insulating a washing machine and, specifically, insulating a laundry tub thereof. As it will be realized, the invention is capable of other different embodiments and its several details are capable of modification in various, obvious aspects all without departing from the invention. Accordingly, the drawing and descriptions will be regarded as illustrative in nature and not as restrictive.

BRIEF DESCRIPTION OF THE DRAWINGS

The accompanying drawings, incorporated in and forming a part of the specification, illustrate several aspects of the present invention and together with the description serves to explain the principles of the invention. In the drawings.

Reference will now be made in detail to the present preferred embodiments of the invention, examples of which are illustrated in the accompanying drawing.

DETAILED DESCRIPTION AND PREFERRED EMBODIMENTS OF THE INVENTION

Figure 1:
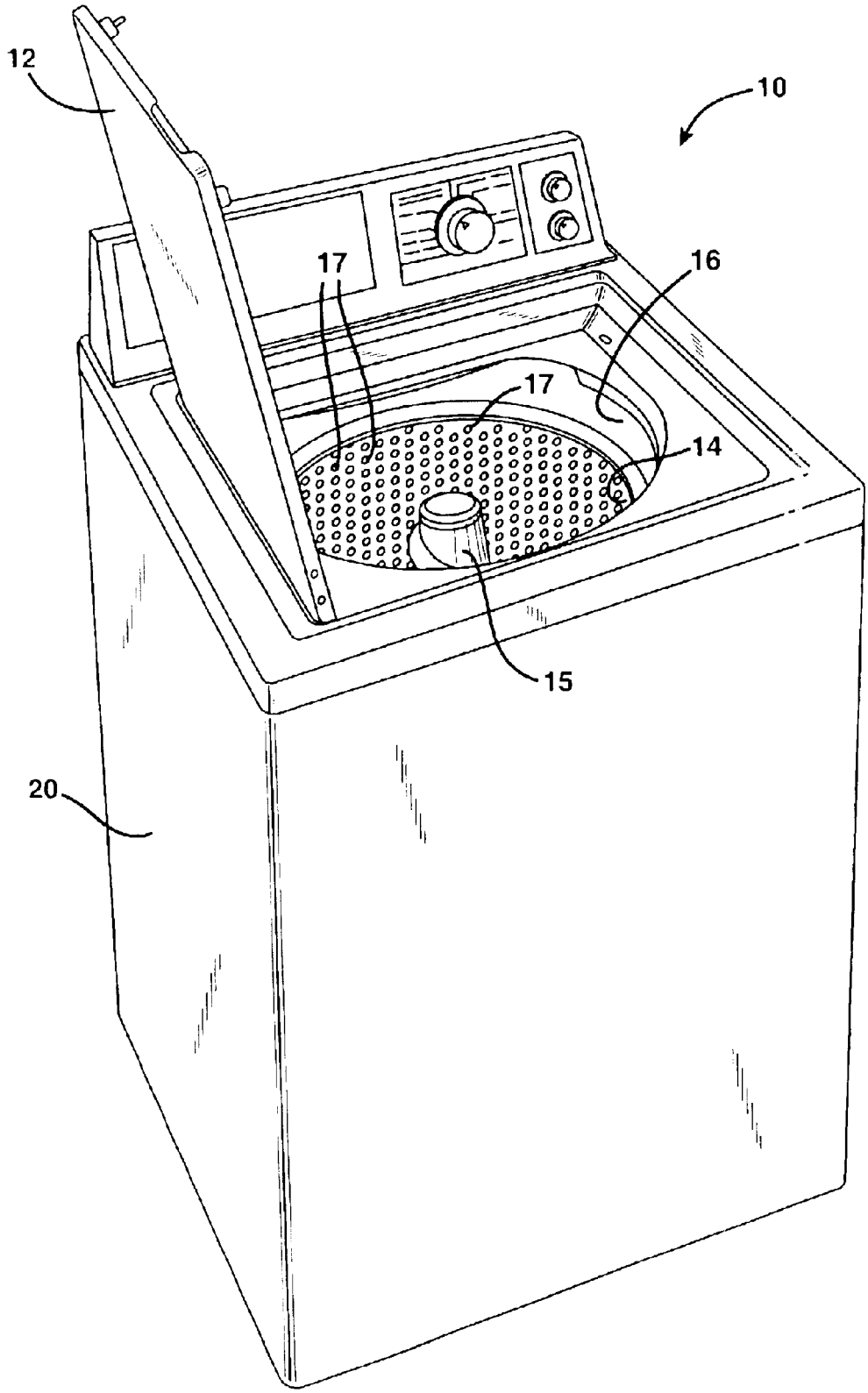
FIG. 1 is a perspective view of a washing machine having an improved acoustical laundry tub blanket.

Reference is now made to FIG. 1 schematically illustrating the washing machine 10 of the present invention having improved acoustical insulation. The washing machine includes a housing 20 and lid 12, operable between an open and closed position, that provides access to an interior 13 of a laundry tub 14. As is known, the interior of the laundry tub provides user access for filling the tub with soiled clothes and washing soap during use. Then, at a minimum, the tub fills with hot and/or cold water from water access lines (not shown), washes the clothes by agitation from a centrally disposed agitator 15, rinses and spins the clothes to remove any excess water. A plurality of holes 17 in the tub allow the tub to drain. A surface 16 provides clearance between the laundry tub 14 and the housing 20.

Figure 2:
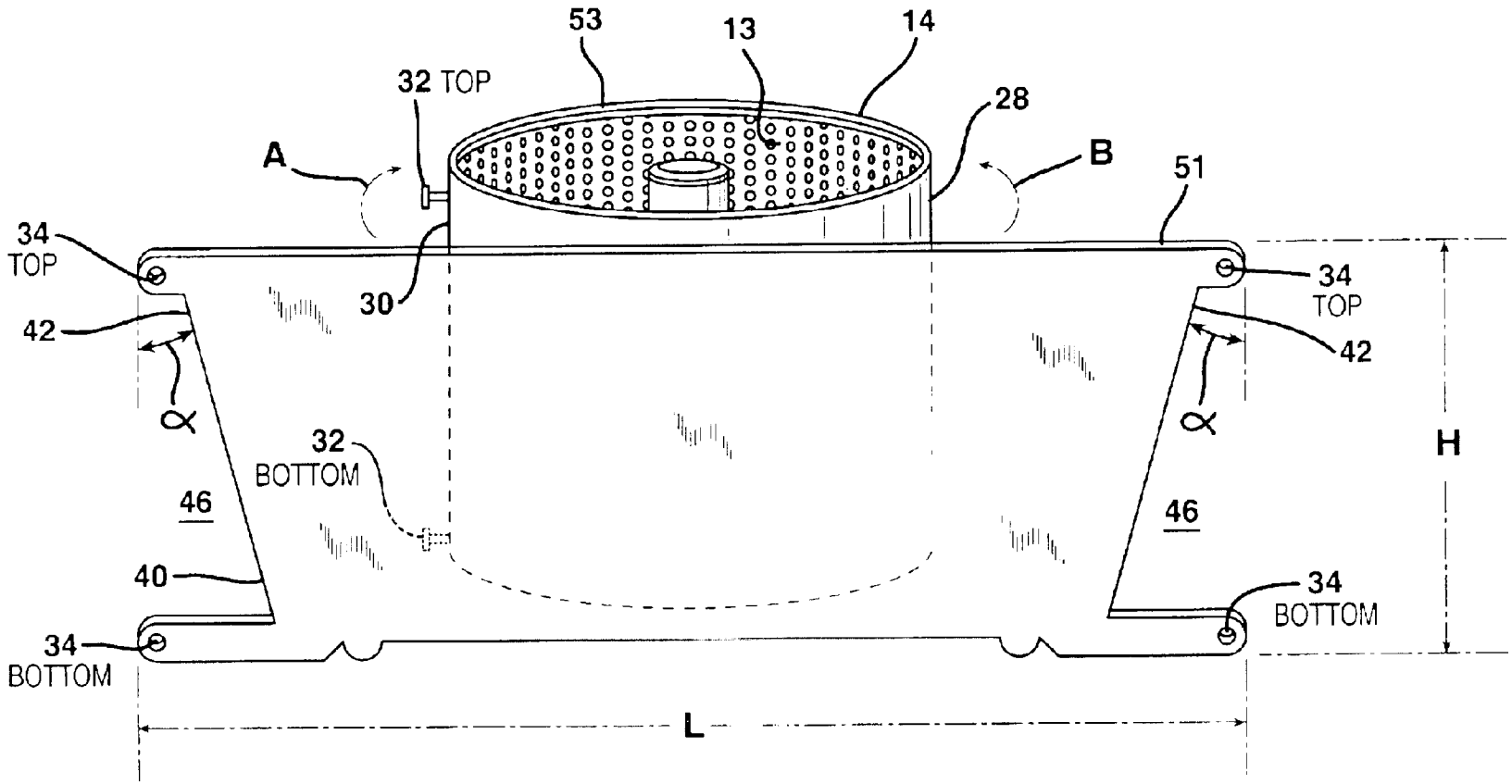
FIG. 2 is a perspective view of a laundry tub of the present invention being wrapped with one embodiment of an improved acoustical blanket.

With reference to FIG. 2, the laundry tub 14 has a wall 28 forming the shape of the tub. Preferably, the wall 28 has a cylindrical shape to facilitate spinning of the clothes during the excess water removal stage of washing, i.e., spin cycle. The wall 28 is disposed on one side thereof to the interior 13 of the tub. On the other side is the exterior 30 of the wall.

On such exterior resides at least one protuberance 32 jutting out a sufficient distance from the wall 28 for mating with at least one hole 34 of an acoustical blanket 40. To mate the hole and protuberance, thereby acoustically insulating the tub, a handler extends the acoustical blanket 40 around the exterior 30 of the wall by wrapping action of the terminal ends 42 in the direction of arrows A and B. Once wrapped, the holes 34 get filled with the protuberances 32 thereby snugly fitting the acoustical blanket 40 about the laundry tub. A top 51 of the acoustical blanket 40 may also be crimped over a top 53 of the wall 28 of the laundry tub thereby allowing closer tolerances between the surface 16 of the housing 20 and the laundry tub. It also serves to assist in resisting centrifugal forces acting on the acoustical blanket during the spin cycle of the tub.

Those skilled in the art should appreciate that the acoustical blanket derives its dimensions from the size of the laundry tub it fits. As an example, however, one embodiment comprises a length, L, of about 50 inches, a height, H, of about 17 to 20 inches, and a thickness of about ¾ to 1½ inches.

Figure 3:
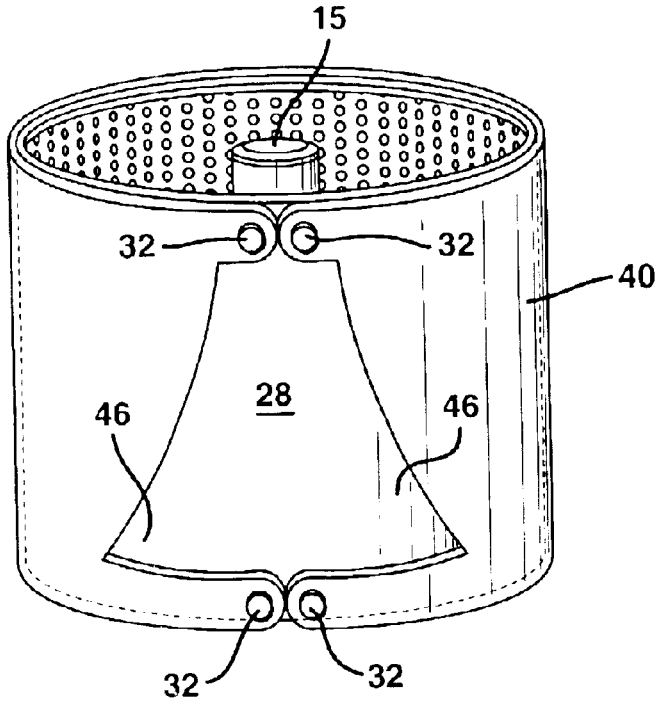
FIG. 3 is a perspective view of a laundry tub having been wrapped with the acoustical blanket of FIG. 2.

With reference to FIG. 3, the acoustical blanket 40 may comprise cutout areas 46 for providing a maintenance access, for example, to the exterior of the wall 28. In one embodiment, the cutouts have angular cuts of about 30° as measured in an angle, $\alpha$ (FIG. 2), from a direction generally parallel to the direction of gravity. In other embodiments, the angular cutout ranges from about 10° to about 60° and about 5° to about 75°.

Regarding the mating of holes with protuberances, those skilled in the art should appreciated that single protuberances can mate with: 1) multiple holes as in FIG. 2, i.e., two holes $\mathbf{34}_{Top}$ or $\mathbf{34}_{Bottom}$ mated with one protuberance $\mathbf{32}_{Top}$ or $\mathbf{32}_{bottom}$, respectively; or 2) single holes as shown in FIG. 3.

Figure 10:
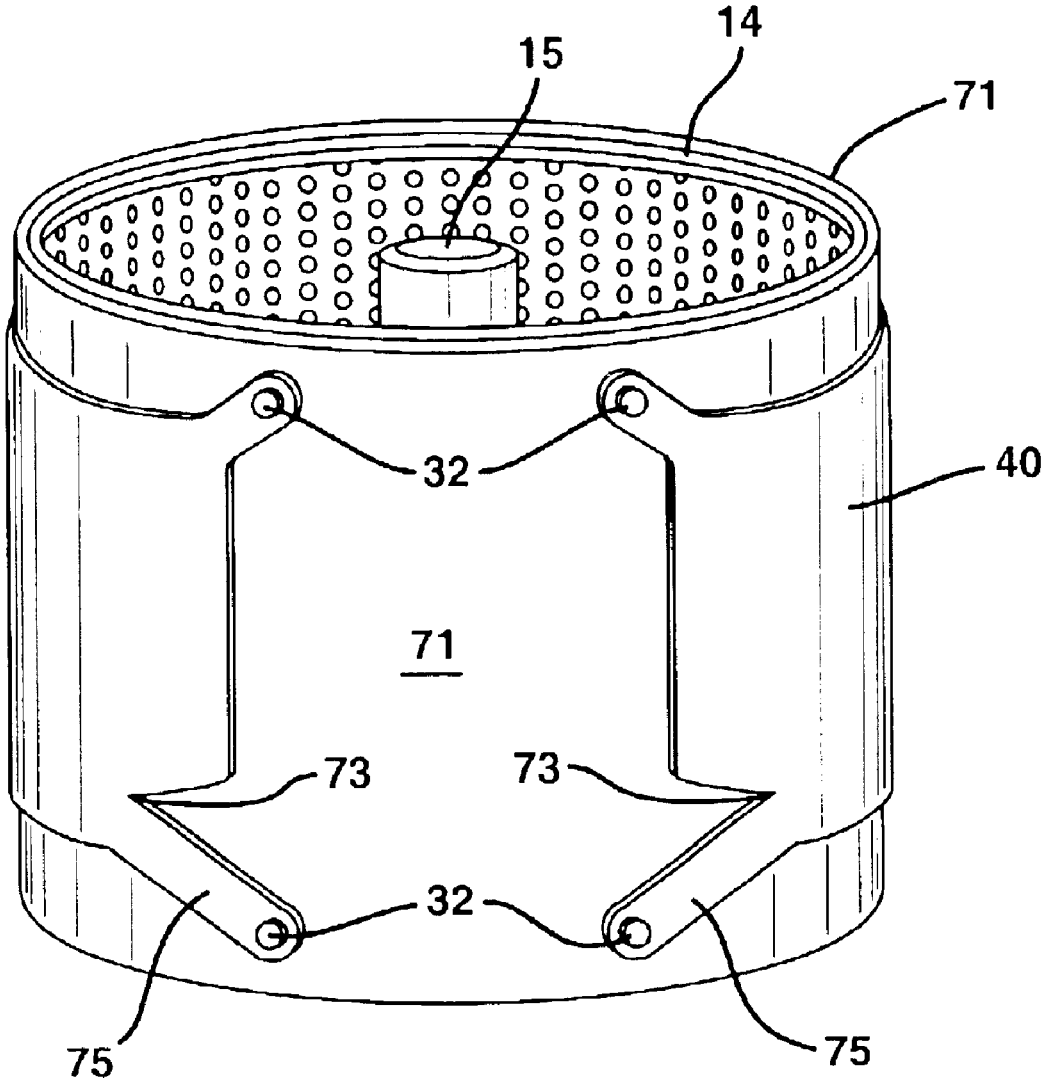
FIG. 10 is a perspective view of still another embodiment of an acoustical blanket for use in a washing machine.

With reference to FIG. 10, those skilled in the art will appreciate that the acoustical blanket of the present invention can mate directly to the washing machine instead of the laundry tub. In such instances, the acoustical blanket 40 may still extend around the laundry tub and comprise the composition, shape and dimensions of FIG. 2, but directly encase a washing machine cylinder 71 that surrounds the laundry tub 14. At cutout areas 73 gaps in the acoustical blanket are introduced so that the straps 75 can be pulled in the axial direction of the cylinder (the same direction as gravity, during use), and prevent a bunching-up of material. In all other aspects, the acoustical blanket is the same as that herein described.

Figure 4:
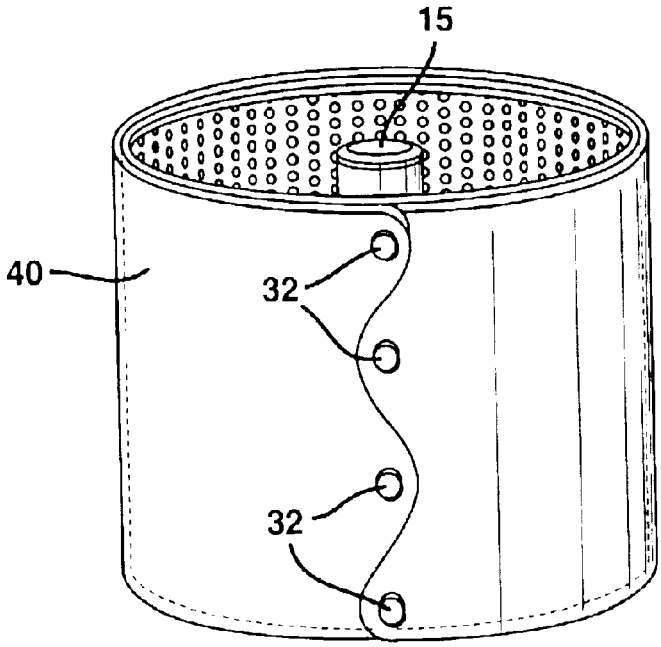
FIG. 4 is a perspective view of a laundry tub of the present invention wrapped with another embodiment of an improved acoustical blanket.
Figure 5:
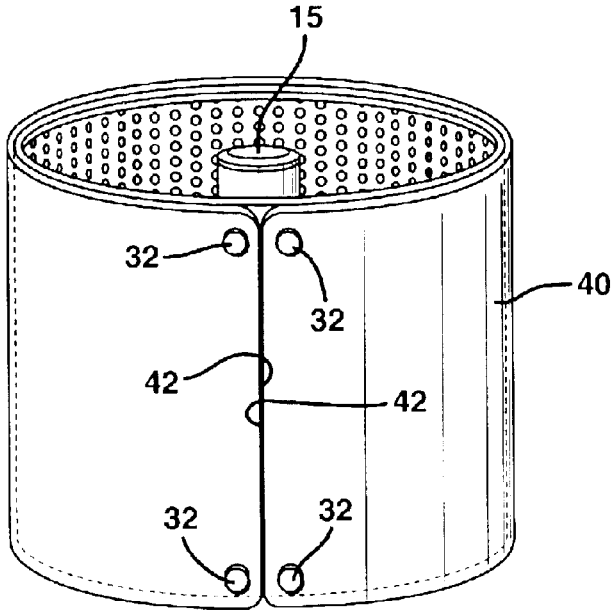
FIG. 5 is a perspective view of a laundry tub of the present invention wrapped with still another embodiment of an improved acoustical blanket.

With reference to FIGS. 4 and 5, the acoustical blanket 40 can additionally include complimentary configured terminal ends 42 that neatly abut one another following extension, about the tub, and mating of the protuberances 32 to the holes. In FIG. 4 the terminal ends comprise an interlocking weave while in FIG. 5 they generally comprise parallel surfaces. Those skilled in the art can envision still other terminal ends providing the advantage of the present invention and all such embodiments are embraced herein.

Figure 6A:
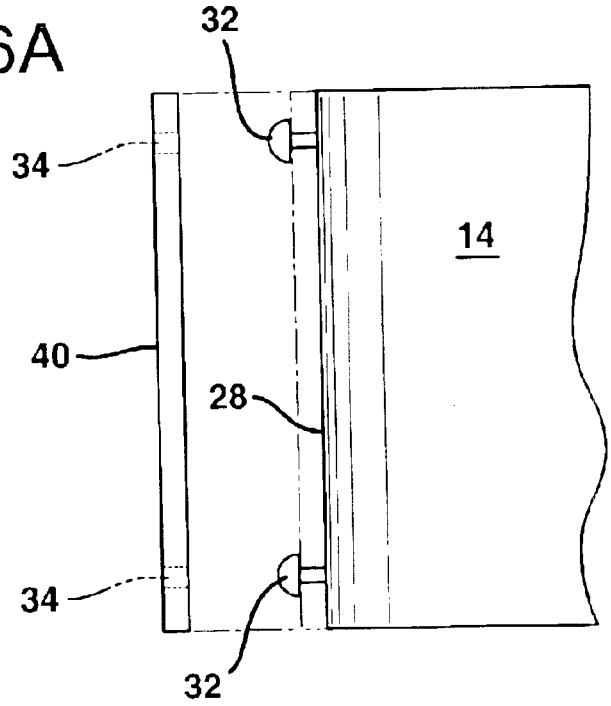
FIG. 6A is a side view of one embodiment of a laundry tub of the present invention mating with an improved acoustical blanket.
Figure 6B:
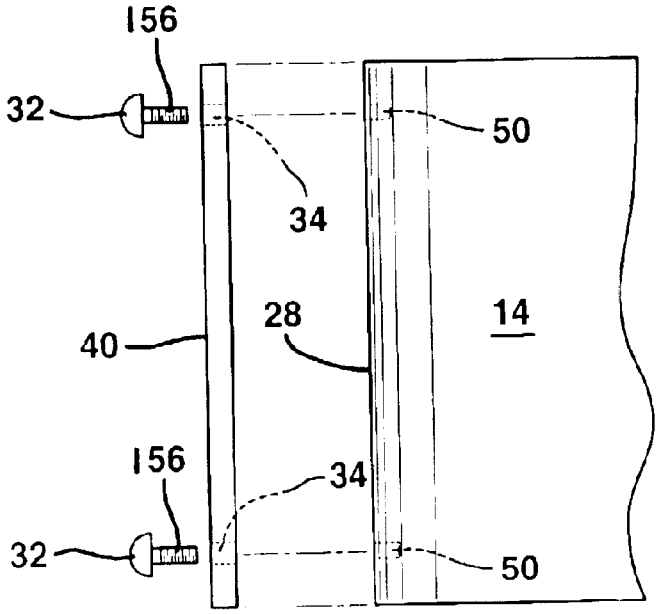
FIG. 6B is a side view of another embodiment of a laundry tub of the present invention mating with an improved acoustical blanket.

With reference to FIG. 6A, the wall 28 of the laundry tub 14 may comprise integrally formed protuberances 32 for mating with the holes 34 of the acoustical blanket 40 in a slide-over-the-protuberance fashion. With reference to FIG. 6B, the wall 28 of the laundry tub 14 may comprise recesses 50 for mating with the protuberances 32 by sandwiching the acoustical blanket 40 there between. The protuberances 32 may have screw bottoms 156 for screwing in the recesses. They may also include snap locks or other.

Figure 8:
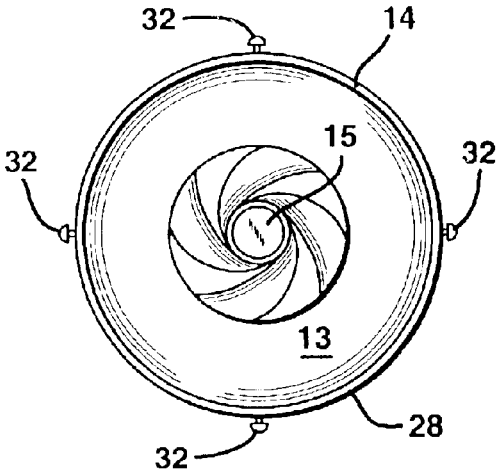
FIG. 8 is a top view of still another embodiment of a laundry tub of the present invention.

While heretofore the laundry tub 14 has only shown protuberances for mating with the terminal ends of the acoustical blanket, with reference to FIG. 8, the laundry tub 14 may also include protuberances at various other locations about a periphery of the wall 28 for mating with the acoustical blanket at numerous other locations. In this manner, sagging of the blanket at regions far removed from the terminal ends might be prevented.

Figure 9:
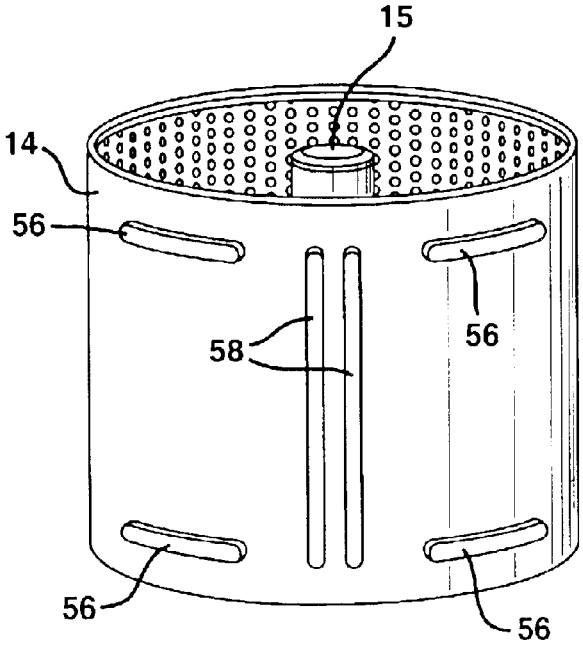
FIG. 9 is a perspective view of still another embodiment of a laundry tub of the present invention.

With reference to FIG. 9, still other embodiments of protuberances exist that afford the present invention with advantage. For example, the protuberances may additionally comprise elongate members 56 arranged horizontally about the exterior 30 of the wall or elongate members 58 arranged perpendicularly. It is also contemplated that they be arranged angularly with respect to the exterior. Beyond the knob shaped protuberances 32 and elongate members 56, 58, the protuberances may still embody other structures such as hooks, clips, rivets, equivalents thereof and other.

Figure 7A:
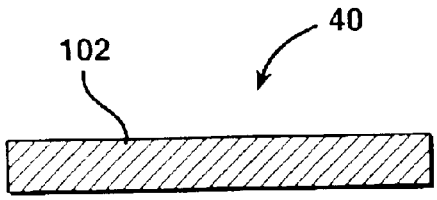
FIGS. 7A–7D are cross-sectional views of various embodiments of the acoustical blanket of the present invention.

FIG. 7A discloses an acoustical blanket 40 having a constant or varying density single layer of thermoplastic material 102 selected from a group of fibers consisting of a polyester, polyethylene, polyolefin, polypropylene, polyethylene terephthalate, rayon, nylon, acrylic, hemp, kenaf, cotton and combinations thereof. In one particularly useful embodiment, the acoustical blanket is formed of polyester stable fibers and polyester bicomponent fibers. These fibers have distinct diameters of between about 8.0 and 50.0 microns and distinct lengths of between about 0.5 and 3.0 inches. It may also include melt blown microfibers if desired.

Figure 7B:
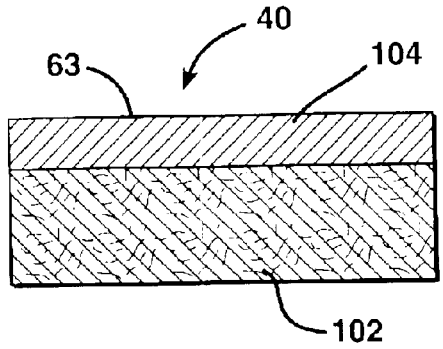
Figure 7C:
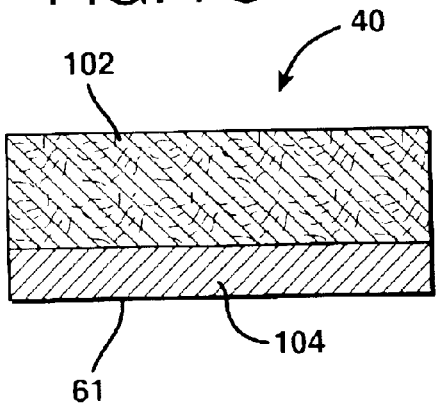
Figure 7D:
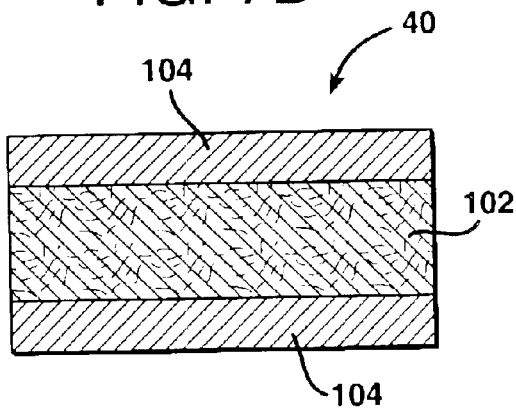

In another embodiment, as shown in FIGS. 7B and 7C, the acoustical blanket 40 may include a facing layer 104 on an interior 63 or exterior 61 surface according to the orientation of the blanket as it extends around the laundry tub following wrapping. While not to be considered as limiting, the facing layer may be made from polyester, polypropylene, rayon, nylon, metallic foil, combinations thereof or other. The facing layer may be reinforced or not. Reinforcements add durability and structural integrity and may comprise fibrous scrims, fibrous mats or fibrous webs. The facing layers 104 may additionally include any appropriate adhesive to ensure good bonding to the thermoplastic material. With reference to FIG. 7D, the facing layers may be provided on both sides of the thermoplastic material 102 as shown.

By replacing one or both of the facing layers 104 with a high density outer skin the acoustical blanket 40 exhibits even further enhanced handling properties and good puncture and tear resistance thereby allowing contour molding characteristics. Such a construction may be achieved by searing and/or layering in accordance with the forming process disclosed and described in U.S. patent application Ser. No. 09/607,478, entitled Process for Forming a Multilayer, Multidensity Composite Insulator, filed on Jun. 30, 2001, herein incorporated by reference.

Final product acoustical blankets of the present invention may even include a core section at least partially constructed from thermoset polymer material, fiber glass, polymer foam, mineral fiber, cardboard and mixtures thereof.

As a result, the final product exhibits unique and useful strength and sound insulating and attenuation properties. The acoustical blanket also enjoys enhanced handling characteristics since the thermoplastic material is void of loose fibers that could otherwise catch on objects and pull on the blanket during installation. Such also reduces the possibility of polymer dust.

The thermoplastic material also imparts a resilient memory to the final product. Thus, the product may be flexed, crimped or other during installation and then returned to its original shape if desired. This is a significant manufacturing benefit.

The foregoing description of the preferred embodiments of the invention has been presented for purposes of illustration and description. It is not intended to be exhaustive or to limit the invention to the precise form disclosed. Obvious modifications or variations are possible in light of the above teachings. For example, the washing machine described includes a top-load machine style and this invention applies equally to front loading machines or other hereinafter invented machines having acoustical noise associated therewith.

The embodiments herein chosen and described provide the best illustration of the principles of the invention and its practical application to thereby enable one of ordinary skill in the art to utilize the invention. All modifications and variations thereto arc within the scope of the invention as determined by the appended claims when interpreted in accordance with the breadth to which they are fairly, legally and equitably entitled.

What is claimed is:

1. A washing machine, comprising:

a housing;

one of a laundry tub and a cylinder in the housing having at least one protuberance thereon; and an acoustical blanket of thermoplastic material having a least one hole, the acoustical blanket extending around the one of the laundry tub and cylinder, the at least one hole filled by the at least one protuberance.

2. The washing machine of claim 1, wherein the acoustical blanket further includes a cutout portion for providing access to a wall of the one of the laundry tub and the cylinder.

3. The washing machine of claim 1, wherein the acoustical blanket further comprises complimentary configured terminal ends.

4. The washing machine of claim 1, wherein the thermoplastic material is selected from a group consisting of polyester, polyethylene, polyolefin, polypropylene, polyethylene terephthalate, rayon, nylon, acrylic, hemp, kenaf, cotton and combinations thereof.

5. The washing machine of claim 1, wherein the acoustical blanket is composed of polyester staple fibers and polyester bicomponent fibers of distinct diameters and lengths.

6. The washing machine of claim 1, wherein the acoustical blanket includes melt blown fibers.

7. The washing machine of claim 1, wherein the acoustical blanket includes a facing layer.

8. The washing machine of claim 7, wherein the facing layer is selected from a group consisting of polyester, rayon, metallic foil and combinations thereof.

9. A washing machine, comprising:

a housing including a lid;

one of a laundry tub and a cylinder in the housing accessible by the lid, the one of the laundry tub and cylinder having a wall with at least one protuberance thereon; and an acoustical blanket of thermoplastic material having a least one hole, the acoustical blanket extending snugly around the wall of the one of the laundry tub and cylinder, the at least one hole filled by the at least one protuberance.

10. The washing machine of claim 9, wherein the one of the laundry tub and cylinder includes a plurality of vertically arranged protuberances.

11. The washing machine of claim 9, wherein the at least one protuberance mates with a recess in the wall of the one of the laundry tub and cylinder.

12. The washing machine of claim 9, wherein the at least one protuberance includes one of an elongate member and a knob.

13. A method of insulating a washing machine, comprising:

providing a laundry tub with a protuberance on a wall thereof;

enclosing the laundry tub with an acoustical blanket of thermoplastic material having a hole; and mating the protuberance with the hole.

14. The method of claim 13, including crimping an upper surface of the acoustical blanket over a top of the wall.

15. The method of claim 13, including providing an access to the wall of the laundry tub.

* * * * *